United States Patent [19]

Jansen

[11] Patent Number: 4,881,394

[45] Date of Patent: Nov. 21, 1989

[54] METHOD AND APPARATUS FOR IRONING THE WALL OF A ONE-PIECE CYLINDRICAL BODY

[75] Inventor: Egbert Jansen, Purmerend, Netherlands

[73] Assignee: Hoogovens Groep B.V., Ijmuiden, Netherlands

[21] Appl. No.: 215,562

[22] Filed: Jul. 6, 1988

[30] Foreign Application Priority Data

Jul. 10, 1987 [NL] Netherlands ..... 8701623

[51] Int. Cl.[4] ..... B21D 22/20

[52] U.S. Cl. ..... 72/45; 72/347

[58] Field of Search ..... 72/41, 43, 44, 45, 286, 72/347, 348, 349, 467

[56] References Cited

U.S. PATENT DOCUMENTS

| | | | |
|---|---|---|---|
| 1,896,674 | 2/1933 | Longwell | 72/41 X |
| 2,821,156 | 1/1958 | Lyon | 72/43 |
| 3,423,985 | 1/1969 | Stolle et al. | 72/348 |
| 4,015,459 | 4/1977 | Winter et al. | 72/45 |
| 4,038,859 | 8/1977 | Pavleszek | 72/347 |
| 4,173,882 | 11/1979 | Lee, Jr. | 72/349 |

FOREIGN PATENT DOCUMENTS

| | | | |
|---|---|---|---|
| 0005084 | 10/1979 | European Pat. Off. . | |
| 2102173 | 4/1972 | France . | |
| 52-9613 | 3/1977 | Japan | 72/45 |
| 140405 | 1/1961 | U.S.S.R. | 72/45 |
| 1260057 | 9/1986 | U.S.S.R. | 72/44 |
| 2112685 | 7/1983 | United Kingdom . | |
| 2155378 | 9/1985 | United Kingdom . | |
| 2181082 | 4/1987 | United Kingdom . | |

*Primary Examiner*—E. Michael Combs

*Attorney, Agent, or Firm*—Stevens, Davis, Miller & Mosher

[57] ABSTRACT

In the wall ironing of a deep-drawn cylindrical body, two ironing ring die regions provide respectively immediately successive first and second thickness reduction phases which take place simultaneously with a relatively small reduction occurring in the first phase and a relatively large reduction occurring in the second phase. Lubricant is applied to the outer surface of the body via inlet between the two die regions. To achieve a high mount of reduction with low applied force, the annular space bounded by the contact regions of the body with said two die regions and the portion of the body located between said two contact regions is fluid-tightly sealed, apart from inlet or inlets for said lubricant, and said space is so shaped and the lubricant is applied through said inlet or inlets at such a pressure that at the second die region hydrodynamic lubrication of the body and die region is achieved.

17 Claims, 3 Drawing Sheets

METHOD AND APPARATUS FOR IRONING THE WALL OF A ONE-PIECE CYLINDRICAL BODY

BACKGROUND OF THE INVENTION

1. Field of the Invention

The invention relates to a method for ironing the wall of a deep-drawn cylindrical body in at least one thickness reduction stage. The invention also relates to apparatus for carrying out such a method, having at least one ironing ring die and a ram which forces the body through the die.

2. Description of the Prior Art

In ironing methods known in current canmaking practice, it is common for the ironing of the wall to be done in three reduction stages. This is illustrated by FIG. 1 of the drawings accompanying the present application. See also EO-A-5084, GB-A-2112685, GB-A-2155378 and GB-A-2181082. For processes apparently involving two reduction stages see GB-A-1345227, US-A-3423985, US-A-4038859 and US-A-4173882. Immediately prior to the reduction stages, there may be a drawing die, in which the ram or punch reshapes a flat metal blank into a body with a cylindrical wall.

The cylindrical body formed by ironing the wall is filled with a product e.g. a beverage, generally after applying a layer of varnish to the inside, after which a lid is joined to the flanged edge at the open end of the cylinder body.

Constant endeavours are made to reduce the cost of packaging the product, i.e. the costs of the cylindrical body and the lid.

One of the possibilities is to reduce the quantity of material from which the cylindrical body is made. The usual dimensions for a beverage can (see EP-A-122651) are a bottom thickness of about 0.3 mm, a wall thickness of about 0.10 mm and a flange at the open end of the cylindrical body with a thickness of about 0.16 mm.

Reducing the quantity of material in such a can while maintaining the capacity is only possible by reducing the thickness dimensions of the can. Endeavours are particularly directed towards reducing the wall thickness. In known methods this is however not easily possible; this is to be attributed especially to the size of the reduction stages which are required to produce a cylindrical body with a smaller wall thickness. Large reduction stages in fact rapidly lead to the formation of cracks during ironing of the wall. It has also appeared that the cylindrical body, depending on the combination of reduction stages, acquires an undesirable, for example, dull, external appearance.

It is known to have two thickness reduction stages occurring simultaneously in two successive ironing dies. This is apparantly the case in EP-A-5084 and US-A-4038859 mentioned above. Where both thickness reductions are substantial, this requires very large ram forces, which tend to damage the can. It is also known, from GB-A-1345227 to employ an ironing die structure in which two die rings are closely adjacent and the first die ring effects only a pre-sizing or slight thickness reduction prior to the main thickness reduction in the second die ring. This pre-sizing is said to amount to "skimming off" of any areas of excessive thickness of the cylindrical wall.

SUMMARY OF THE INVENTION

The object of the present invention is to provide an ironing method and apparatus in which low ram forces are required and by which a high thickness reduction can be achieved in a small number of reduction stages and with low risk of damage to the body being ironed.

The invention consists in a method for ironing the wall of a deep-drawn cylindrical body including at least one thickness reduction stage in which two ironing ring die regions provide immediately successive first and second thickness reduction phases which take place simultaneously with a relatively small reduction occurring in the first phase at the first die region and a relatively large reduction occurring in the second phase at the second die region, lubricant being applied to the outer surface of the body being ironed at the location between said two die regions. This method is characterized in that the annular space outside the wall bounded by the contact regions of the body with said two die regions and the portion of the body located between said two contact regions is fluid-tightly sealed, apart from inlet or inlets for said lubricant, and in that said space is so shaped and the lubricant is applied through said inlet or inlets at such a pressure that at the second die region hydrodynamic lubrication of the body and die region is achieved.

The first reduction phase serves to provide some thickness reduction and also to centre the cylindrical body being formed before the ring die of the second reduction phase comes into operation. A gradual build-up of tension thus occurs with a homogeneous dirstibution around the circumference of the cylindrical wall. The danger of cracks is thus effectively reduced. Preferably, the thickness reduction occurring in said first reduction phase is in the range 10–30% of the thickness reduction occurring in said second reduction phase.

It is particularly important in the invention that hydrodynamic lubrication is achieved in the second die region. In hydrodynamic lubrication, there is no direct contact between the doby of the can and the die, and very high lubricant pressure is required to achieve this. This is the reason for the sealing of the annular space between the die regions in the invention. The shaping of the die structure is important in this respect since the moving cylindrical body can be used to effect pressure increase. In particular in the invention it is preferred that the said annular space outside the wall includes an elongate narrow region between the lubricant inlet or inlets and the second die region, lubricant being entrained by the body being ironed along said elongate narrow region bowards said second die region with increase of pressure.

GB-A-2181082 describes the use of coolant to provide hydrodynamic forces, whose function is to damp and restrain the can and punch against transverse vibration. It is not disclosed that hydrodynamic lubrication occurs.

One effect of hydrodynamic lubrication is to reduce the ram force required considerably. The supply of lubricant also ensure that the temperature of the cylindrical body increases only moderately during the ironing of the wall and is for example limited to approximately 200° C. which has a favourable effect on the external appearance of the can. Lubricant pressure at the inlet to the annular space is preferably 40 to 100 (4 to 10 MPa).

With the invention, it has also appeared possible to reduce the usual amount of tin on the starting material, at least on the side which comes into contact with the die rings for carrying out the reduction stages. Although the quantity of tin on the flat sheet material is as a rule only a few grams per square meter, a slight reduction in this quantity, due to the high price of tin, represents an important saving in cost for the can manufacturer.

Preferably the lubricant is non-emulsifiable. This has the advantage that the lubricant can be easily recovered from the mixture which is produced with an emulsion may be applied for cooling during the ironing of the wall. The lubricant effect is improved if the lubricant has at least the viscosity of water.

It has appeared possible with the invention that the number of the reduction stages can be equal to two, even with large thickness reduction.

The invention also relates to wall ironing apparatus for ironing the wall of a deep-drawn cylindrical body having a ram and at least one ring die structure for reducing the wall thickness of the body forced through the die structure by the ram, wherein said die structure has successive first and second ring die regions arranged for simultaneously performing a wall thickness reduction in two phases, the first die region having an internal diameter slightly larger than that of said second die region and the die dimensions being such that the first die region performs a relatively small reduction while the second die region performs a relatively large reduction, there being at least one inlet for introducing lubricant to the outer surface of the body being ironed between the first and second die regions. This apparatus is characterized in that said die structure is constructed to provide fluid tight sealing of the annular space which in use is bounded by die structure and the portion of the body between the contact regions of the body with the first and second die regions and in that the die structure includes an elongate face of internal diameter slightly greater than that of the second die region and bounding the annular space at a region between the lubricant inlet or inlets and the second die region whereby a narrow region of said annular space is provided along which in use lubricant is entrained towards the second die region by the moving body being ironed.

Preferably the axial length of said elongate face is at least 25% of the distance between (spacing) of the first and second die regions. Preferably also said elongate face is cylindrical.

It is easily possible to introduce the lubricant into the above-mentioned annular space via one or more openings, which direct the lubricant radially. Better filling of the annular space is however achieved if the connecting part has at least one opening suitable for bringing the lubricant at least partly in a tangential direction into the annular space. The narrow elongate region of the annular space is particularly suitable for allowing the pressure in the direction of the second die region to increase, so that the desired hydrodynamic lubrication is achieved in the zone of the second die region. The pressure near the second die region may amount to approximately 2000–8000 bars and the temperature of the cylindrical body increases only moderately due to the slight friction.

Preferably the first die region has an entry angle in the range of 8° to 10° and a land zone in the range of 0.2–0.9 mm in axial length. It has appeared particularly advantageous for the entry angle to be about 8° and the land zone about 0.3 mm. the land zone is understood to be that part of the ring, which, if there were no lubrication, would be in direct contact with the wall of the cylindrical body.

Preferably the entry angle of the second die region is in the range 5°–10 °, more preferably 5° to 7°. With hydrodynamic lubrication, an entry angle of about 6° has been found especially effective.

It is advantageous that there is provided the construction with double reduction rings suitable for carrying out a maximum of two reduction stages. In this way the total wall thickness reduction can take place over a shorter distance than is possible with known wall ironing machines which requires three reduction stages. In this way the stroke of the wall ironing machine can be shortened and in consequence the production capacity increased while maintaining the speed of deformation.

In the apparatus preferably said first and second die regions and said elongate face are all portions of a one-piece body.

By the invention it has proved possible to reduce the wall thickness of the one-piece cylindrical body to 0.085 mm maximum.

BRIEF INTRODUCTION OF THE DRAWINGS

The invention will be illustrated further by way of non-limitative example with reference to the accompanying drawings, in which:

FIGS. 1A, 1B, and 1C show in axial section an ironing apparatus with three reduction rings, as is conventional.

FIG. 2 shows in axial section part of the construction of a double reduction ring used in ironing apparatus according to the invention.

FIGS. 3A, 3B, 3C, and 3D are a series of graphs showing wall ironing and friction forces.

DESCRIPTION OF THE PREFERRED EMBODIMENT

Figure 1A:
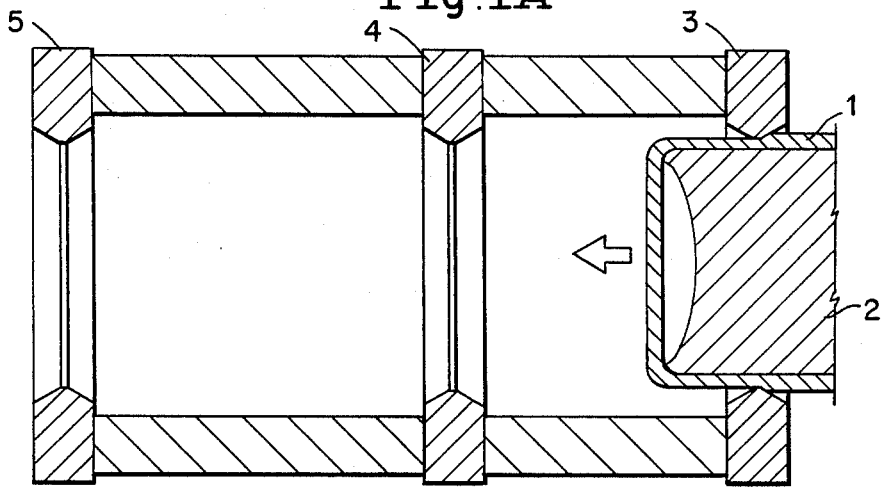
Figure 1B:
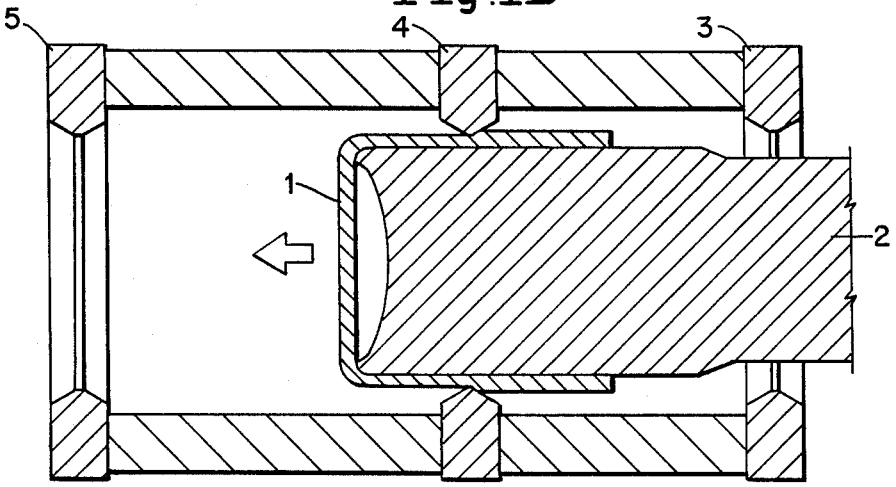
Figure 1C:
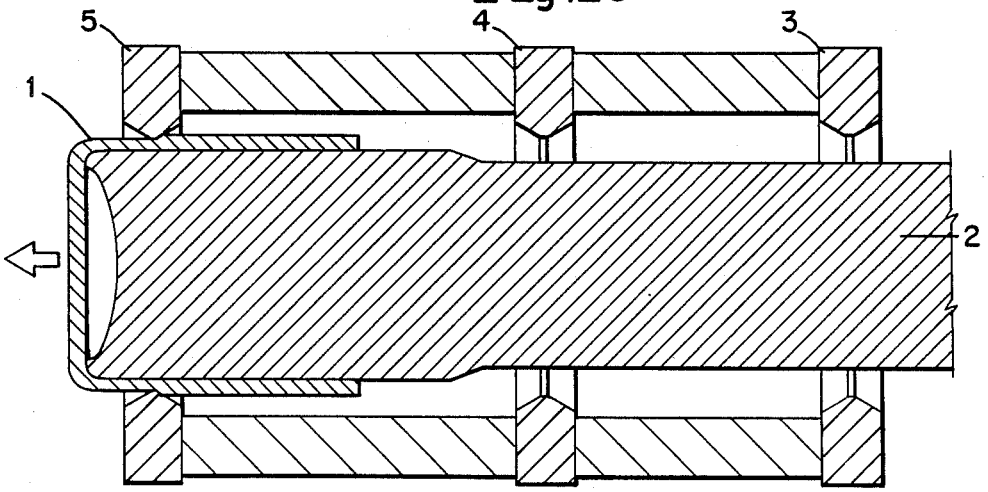

FIGS. 1A, 1B and 1C show how a deep-drawn cylindrical body 1 is carried sequentially by a ram 2 through three spaced reduction rings 3, 4 and 5 and in so doing undergoes different phases of the wall ironing process. During each phase of this conventional wall ironing process the cylindrical body 1 passes through at most only one reducer 3, 4 or 5 at the same time.

Figure 2:
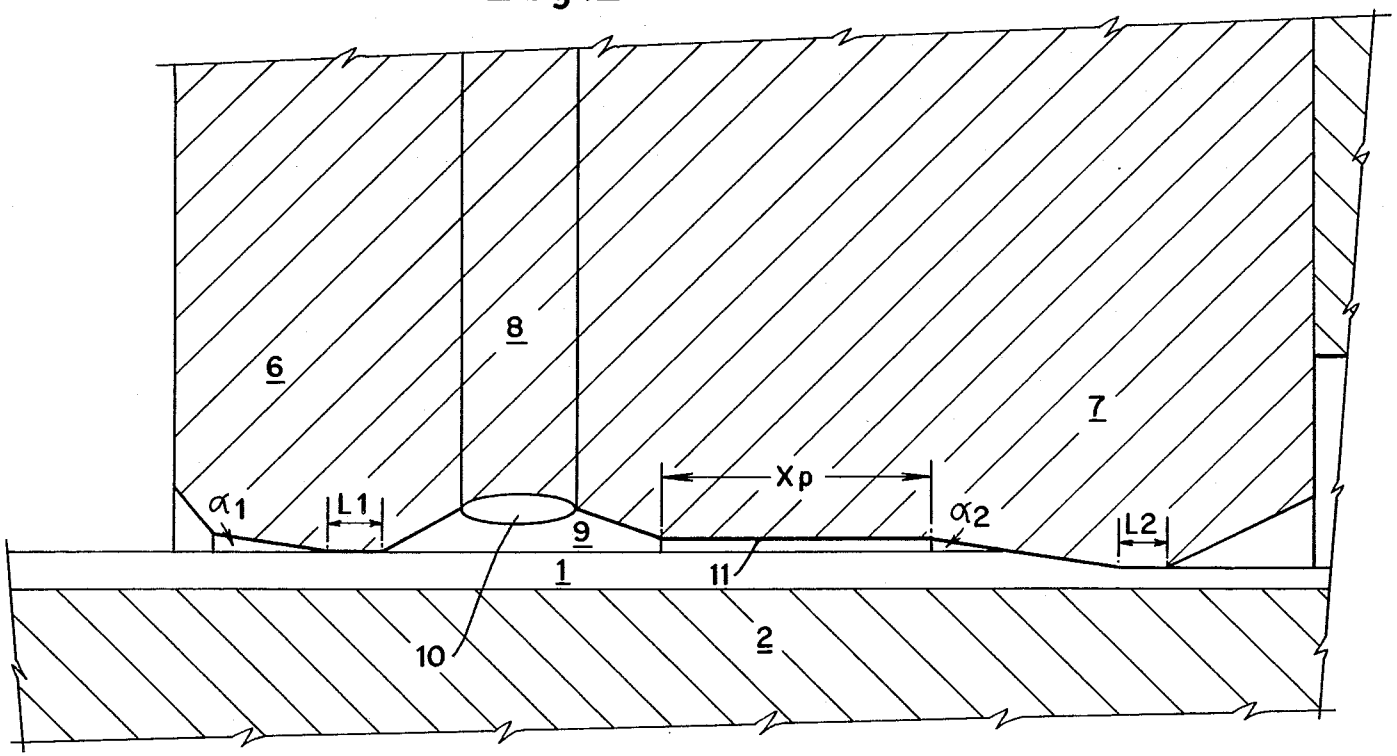

According to the invention there is provided, for at least one of the reduction stages, a reduction ring 3, 4 or 5 in the form of a double reduction ring according to FIG. 2. This consists of a one-piece annular body which has first and second die regions 6,7 separated by a recessed region 8 which includes a lubricant inlet 10 and a cylindrical elongate surface 11 of length $X_p$. The reduction stage consists of an initial reduction phase with a small thickness reduction, for example 10% in a first die region 6, and the wall reduction stage is completed by a second die region 7 with a thickness reduction of 50% for example.

The first reduction phase in the first die region 6 takes place under usual conditions. Thus emulsion is introduced for cooling and the emulsion, together with the tin coating on the body, ensures lubrication on the outer surface of the cylindrical body 1. The outer surface of the cylindrical body 1 is in direct contact with the first and second ring 6,7.

The entry angle $\alpha_1$ of the die region 6 is both in the range 8°–10° and is preferably 8°. The land zone L1 of the first die region 6 lies in the range 0.2–0.9 mm and is preferably 0.3 mm.

In the recessed region part 8 between first die region 6 and second die region 7 there are also provided (not shown) means for introducing lubricant which is brought via at least one inlet 10 into the annular space 9 which is bounded by first die region 6, connecting part 8, second die region 7 and cylindrical body 1 being ironed. The inlet 10 is directed, as much as possible, tangentially to the connecting part 8. This seems to promote good filling of the annular space 9 with the lubricant. In practice, the annular space 9 is filled with lubricant. The lubricant is non-emulsifiable so that it can be easily separated for re-use from the emulsion appied. The viscosity of the lubricant is also at least equal to that of water. All these conditions must be selected depending on the material from which the cylindrical body 1 is made. Generally the viscosity should be selected high enough that the pressure build-up in the space 9 is not prevented by lubricant escaping between the cylindrical body 1 and second die region 7.

The connecting part 8, and especially the elongate surface 11, is formed in such a way that its inside diameter is only a little larger than the inside diameter of the first die region 6. Thus a large part of the annular space 9 is a narrow annular zone closely adjacent the cylindrical body 1 so that the pressure build-up as the lubricant is entrained by the moving body 1 in the direction of the second die region 7, i.e. the direction of movement of the ram 2 during wall ironing, is promoted. Thus hydrodynamic lubrication at the second die region is achieved.

Because of the division whereby the first small reduction phase serves for centering for the second reduction phase, the reduction stage in two reduction phases is characterised in that there is little tendency to crack formation during the wall stretching process.

It has appeared possible in this manner and with this apparatus to manufacture a cylindrical body with a super-thin wall of 0.085 mm maximum, using not more than two double reduction rings according to the invention. For this purpose the double reduction rings are for example mounted in place of the reduction rings 4 and 5 (FIG. 1). It is also possible for example to use one double reduction ring only in place of reducer 5. All this is dependent on the desired thickness dimension of the cylindrical body 1 to be manufactured.

Figure 3A:
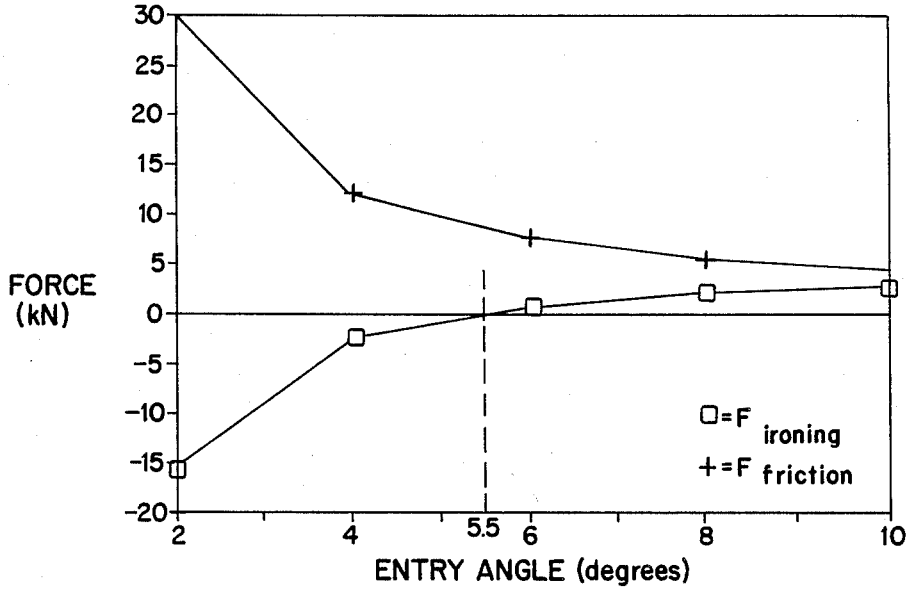
Figure 3B:
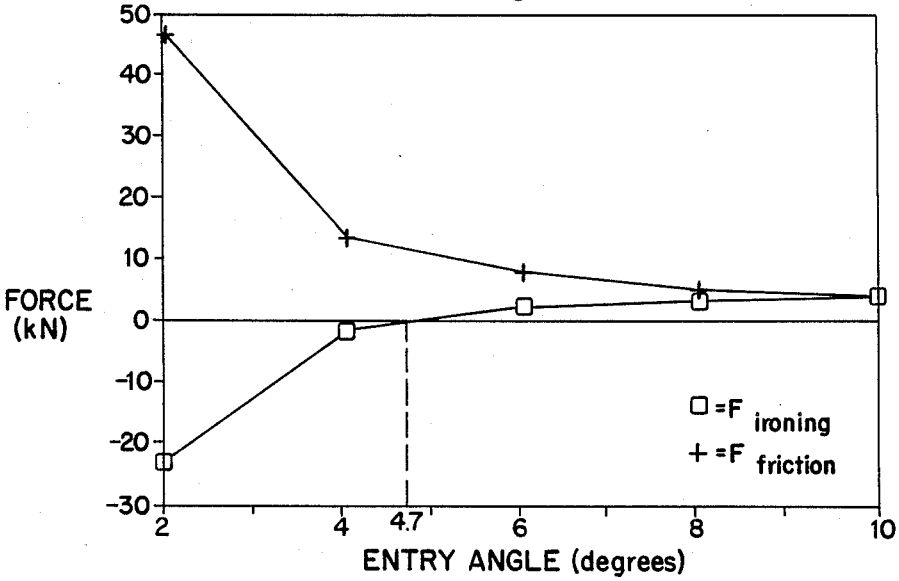
Figure 3C:
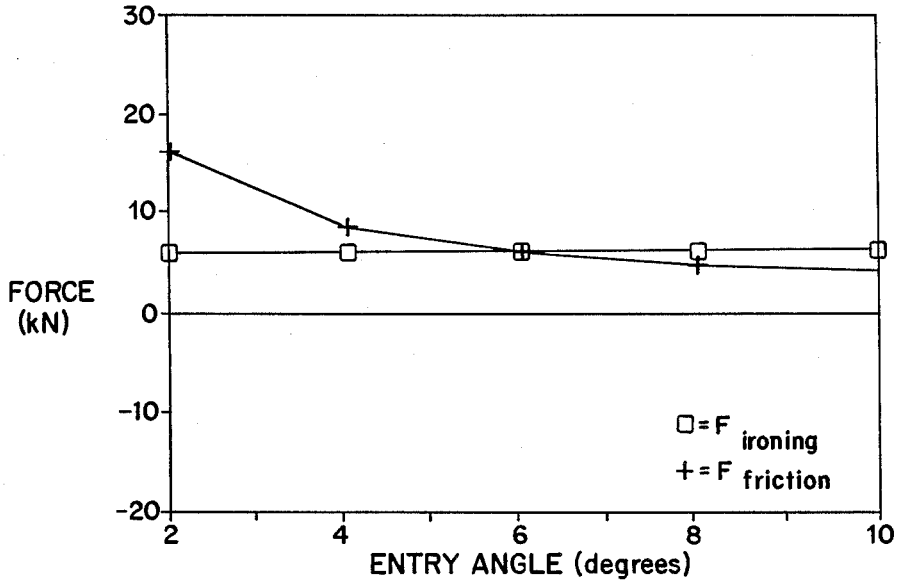
Figure 3D:
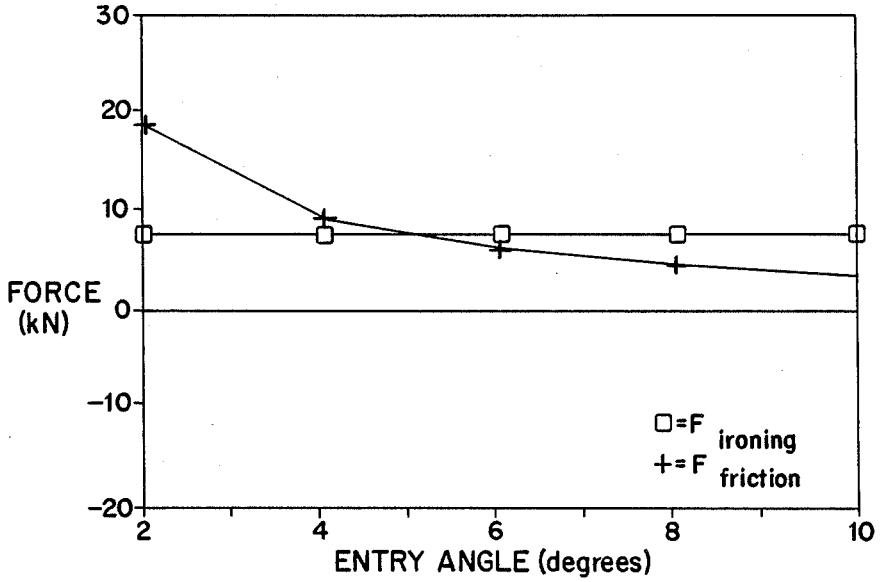

FIGS. 3A to D show graphically the variation of the two components of the ram force applied to the body being ironed with entry angle to the second die region 7 in the apparatus of the invention shown in FIG. 2. These two force components are $F_{ironing}$, the force required for wall thickness reduction and $F_{friction}$, the frictional force in the second die region. These two components must be summed to find the total force. In each case the wall thickness reduction in the first die region 6 was from 0.15 mm to 0.14 mm. In the second die region the reduction was 36% in FIGS. 3A and 3C (i.e. to 0.09 mm) and 50% in FIGS. 3B and 3D (i.e. to 0.07 mm). In the case of FIGS. 3A and 3B hydrodynamic lubrication was achieved, and it can be seen that in both cases that minimum total force ($F_{ironing}+F_{friction}$) is at about 6° entry angle. FIGS. 3C and 3D show the results without hydrodynamic lubrication, and demonstrate that the conventional value of 8° entry angle is an appropriate choice in that case.

To provide some figures, the thickness reduction from 0.15 to 0.14 mm in the first die region in all cases required a force of 1.45 kN. With an entry angle of 8° in the second die region, the force required for reduction of 36% (to 0.09 mm) was 6.08 kN without hydrodynamic lubrication and 2.02 kN with hydrodynamic lubrication, giving totals for both die regions of 7.53 and 3.47 kN respectively. With an entry angle of 6° at the second die region and with hydrodynamic lubrication, the force at the second die region (for the same 36% reduction) was as low as 0.67 kN, i.e. a total of 2.12 kN for the two die regions.

What is claimed is:

1. Wall ironing apparatus for ironing the wall of a deep-drawn cylindrical body having a ram and at least one ring die structure for reducing the wall thickness of the body forced through the die structure by the ram, wherein said die structure has successive first and second ring die regions arranged for simultaneously performing a wall thickness reduction in two phases, the first die region having an internal diameter slightly larger than that of said second die region and the die dimensions being such that the first die region performs a relatively small reduction while the second die region performs a relatively large reduction, said die structure being constructed to provide a fluid-tight sealed annular space which in use is bounded by die structure and the portion of the body between contact regions of the body with the first and second die regions, there being at least one inlet for introducing lubricant to said annular space, and said die structure including an elongate face of internal diameter slightly greater than that of the second die region and bounding said annular space at a region between the lubricant inlet and the second die region to provide a narrow region of said annular space along which in use lubricant is entrained towards the second die region by the moving body being ironed.

2. Apparatus according to claim 1 wherein the axial length of said elongate face is at least 25% of the distance between the contact regions of the first and second die regins.

3. Apparatus according to claim 1 wherein said elongate face is cylindrical.

4. Apparatus according to claim 1 wherein said lubricant inlet is arranged to inject the lubricant with an at least partly tangential direction into said annular space.

5. Apparatus according to claim 1 wherein the first die region has an entry angle ($\alpha_1$) in the range 8° to 10° and a land zone with an axial length ($L_1$) in the range 0.2 to 0.9 mm.

6. Apparatus according to claim 5 wherein the entry angle ($\alpha_1$) of the first die region is about 8° and its land zone ($L_1$) about 0.3 mm in axial length.

7. Apparatus according to claim 5 wherein the entry angle ($\alpha_2$) of the second die region lies in the range 5° to 10°.

8. Apparatus according to claim 2 wherein the entry angle ($\alpha_2$) of the second die regin is about 6°.

9. Apparatus according to claim 1 wherein said first and second die regions and said elongate face are all portions of a one-piece body.

10. Apparatus according to claim 1 having ring die structures for a maximum of two thickness reduction stages.

11. Method for ironing the wall of a deep-drawn cylindrical body comprising reducing the thickness of the wall in at least one thickness reduction stage in which two ironing ring die regions provide immediately successive first and second thickness reduction phases which take place simultaneously with a relatively small reduction occurring in the first phase at the first die region and a relatively large reduction occurring in the second phase at the second die region, providing an annular space outside the wall and bounded by contact regions of the body with said two die regions and the portion of the body located between said two contact regions, said annular space being fluid-tightly sealed apart from at least one inlet for lubricant, and applying lubricant via said inlet to the outer surface of the body being ironed, wherein said annular space is so shaped and the lubricant is applied through said inlet at such a pressure that at the second die region hydrodynamic lubrication of the body and die region is achieved.

12. Method according to claim 11 wherein said annular space includes an elongate narrow annular region adjacent the body being ironed between said lubricant inlet and said second die region, and the body being ironed entrains the lubricant along said elongate narrow region towards said second die region with consequent increase of pressure.

13. Method according to claim 11 wherein the lubricant is non-emulsifiable.

14. Method according to claim 11 wherein the lubricant has at least the viscosity of water.

15. Method according to claim 11 wherein the number of thickness reduction stages is equal to two.

16. Method according to claim 11 wherein the input pressure of lubricant at said inlet or inlets is in the range 40 to 100 (4–10 mPa).

17. Method according to claim 11 wherein the thickness reduction occurring in said first reduction phase is in the range 10–30% of the thickness reduction occurring in said second reduction phase.

* * * * *